United States Patent [19]

Iseki et al.

[11] Patent Number: 4,481,275

[45] Date of Patent: Nov. 6, 1984

[54] METHOD OF PREVENTING TONER FROM SCATTERING IN AN ELECTROSTATIC COPYING MACHINE

[75] Inventors: Masahide Iseki, Osaka; Tadanobu Nakajima, Nara; Hiroshi Kajita, Hyogo; Masuo Kawamoto, Osaka, all of Japan

[73] Assignee: Mita Industrial Company Ltd., Osaka, Japan

[21] Appl. No.: 459,247

[22] Filed: Jan. 19, 1983

[30] Foreign Application Priority Data

Jan. 30, 1982 [JP] Japan ..... 57-14037

[51] Int. Cl.[3] ..... G03G 13/22

[52] U.S. Cl. ..... 430/125; 355/15

[58] Field of Search ..... 430/106.6, 122, 902, 430/125; 355/15

[56] References Cited

U.S. PATENT DOCUMENTS 3,651,323 3/1972 Tanaka et al. ..... 430/902

4,154,522 5/1979 Ikesue ..... 355/15

4,377,629 3/1983 Tarumi et al. ..... 430/122

*Primary Examiner*—John E. Kittle

*Assistant Examiner*—John L. Goodrow

*Attorney, Agent, or Firm*—Wenderoth, Lind & Ponack

[57] ABSTRACT

A mass of residual charged toner is blocked by a blade member held in slidable engagement with a photosensitive member against movement therewith toward a development roller when an image is being formed on the photosensitive member. When no image is being formed thereon, the blade member is lifted off the photosensitive member to allow the mass of residual toner to move therewith toward the development roller. During this time, a bias potential having a polarity the same as that of the toner is applied to members of an electrostatic or electrographic copying machine located between the blade member and the development roller for repelling the mass of toner toward the photosensitive member against being scattered off the latter and hence smearing surrounding parts.

3 Claims, 2 Drawing Figures

METHOD OF PREVENTING TONER FROM SCATTERING IN AN ELECTROSTATIC COPYING MACHINE

BACKGROUND OF THE INVENTION

1. Field of the Invention

The present invention relates to a method of preventing toner from scattering off a photosensitive member in an electrostatic or electrophotographic copying machine.

2. Description of the Prior Art

Known electrostatic or electrophotographic copying machines include a corona discharger for charging a photosensitive member, the corona discharger having a shield case which is grounded. When the copying machine is in a mode of operation in which an image is being formed, a mass of toner is prevented by a blade member held in sliding contact with the photosensitive member from reaching a development unit as the photosensitive member moves. During a mode of operation in which no image is being formed, the blade member is lifted off the photosensitive member. The toner which is charged positively or negatively now tends to float off the photosensitive member and stick to the shield cases of the corona dischargers. Where the developer is composed of toner and carrier (two-component developer), the toner is light in weight, and liable to scatter around and to smear surrounding parts. One solution would be to incorporate a fan for exhausting toner-laden air, thereby protecting the parts against toner contamination. However, such an attempt would render the overall apparatus excessively complicated.

It is an object of the present invention to provide a method of preventing toner from scattering off a photosensitive member and hence from smearing parts surrounding the photosensitive member when the toner is conveyed to a development unit by the photosensitive member during a mode of operation in which no image is being formed on the photosensitive member.

SUMMARY OF THE INVENTION

According to the present invention, there is provided a method of preventing charged toner from scattering off a movable photosensitive member in an electrostatic copying machine including a corona discharger for charging the photosensitive member, a development unit disposed at the downstream side of the corona discharger with respect to the direction of movement of the photosensitive member and having a development roller, and a blade member disposed at the up stream side of the corona discharger with respect to the direction of movement of the photosentive member. The method comprises the steps of holding the blade member in sliding contact with the photosensitive member in a first mode of operation in which an image is being formed on the photosensitive member to block a mass of toner against movement with the photosensitive member, lifting the blade member off the photosensitive member in a second mode of operation in which no image is being formed on the photosensitive member to allow the mass of toner to move with the photosensitive member toward the development roller, and applying a bias potential of the same polarity as that of the charged toner to members of the electrostatic copying machine, positioned between the blade member and the development roller, other than the photosensitive member during the second mode of operation, for thereby repelling the mass of toner toward the photosensitive member. The bias potential may be negative with respect to ground potential and may be applied to a shield or to a case of the corona discharger when the toner is charged negatively.

DETAILED DESCRIPTION OF THE PREFERRED EMBODIMENT

Figure 1:
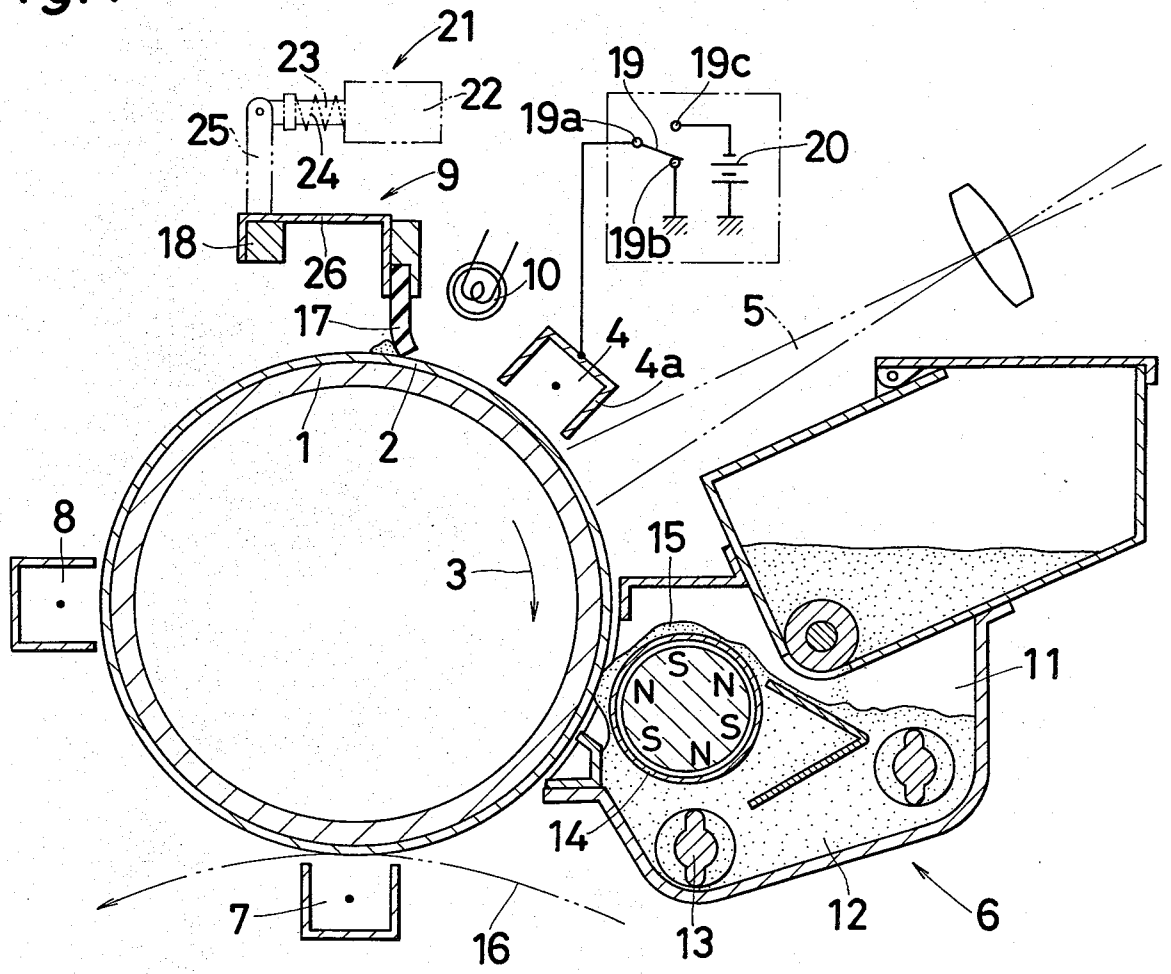
FIG. 1 is a cross-sectional view of an electrostatic copying machine with which the method of the present invention is carried out.

As shown in FIG. 1, an electrostatic or electrophotographic machine has a drum 1 rotatable in the direction of an arrow 3 and supporting thereon a photosensitive layer 2. Around the drum 1, there are disposed a corona discharger 4 for charging the photosensitive layer 2, an exposure means 5, a development unit 6 forming a magnetic brush, a corona discharger 7 for transferring a toner image onto a sheet of recording paper, a charger remover 8, a cleaner assembly 9, and a charge removing lamp 10, these components being arranged at successive intervals in the order named along the direction of the arrow 3.

During a copying operation, the photosensitive layer 2 which has been cleaned by the cleaner assembly 9 is charged positively by the corona discharger 4. The exposure means 5 serves to irradiate the surface of the photosensitive layer 2 with a light image corresponding in pattern to an original to be copied for thereby forming an electrostatic latent image on the surface of the photosensitive layer 2. The development unit 6 includes a developer container 11 storing therein a two-component developer 12 that is stirred by stirring member 13 and delivered to a development roller 14, around which is formed a magnetic brush 15 is formed of the developer 12. The electrostatic latent image on the photosensitive layer 2 is developed into a visible image by the toner of the magnetic brush 15 which is charged nagatively and brought into contact with the photosensitive layer 2. The visible toner image is then transferred from the surface of the photosensitive layer 2 as discharged by the corona discharger 7 onto the sheet of recording paper which is fed in the direction of an imaginary-line arrow 16 in synchronism with rotation of the drum 1. The sheet of recording paper onto which the toner image has been transferred is transported to a fixation unit (not shown). Any residual toner on the photosensitive layer 2 after the toner image has been transferred therefrom is removed by the cleaner assembly 9.

The cleaner assembly 9 is composed of a blade member 17 held in sliding contact with the photosensitive layer 2 and a support member 26 supporting the blade member 17 on a shaft 18 extending parallel to an axis of the drum 1. The shaft 18 is angularly movably supported on a machine frame (not shown) and drivable to turn about its own axis by a driver 21 so that the blade member 17 will be moved toward and away from the photosensitive layer 2.

Figure 2:
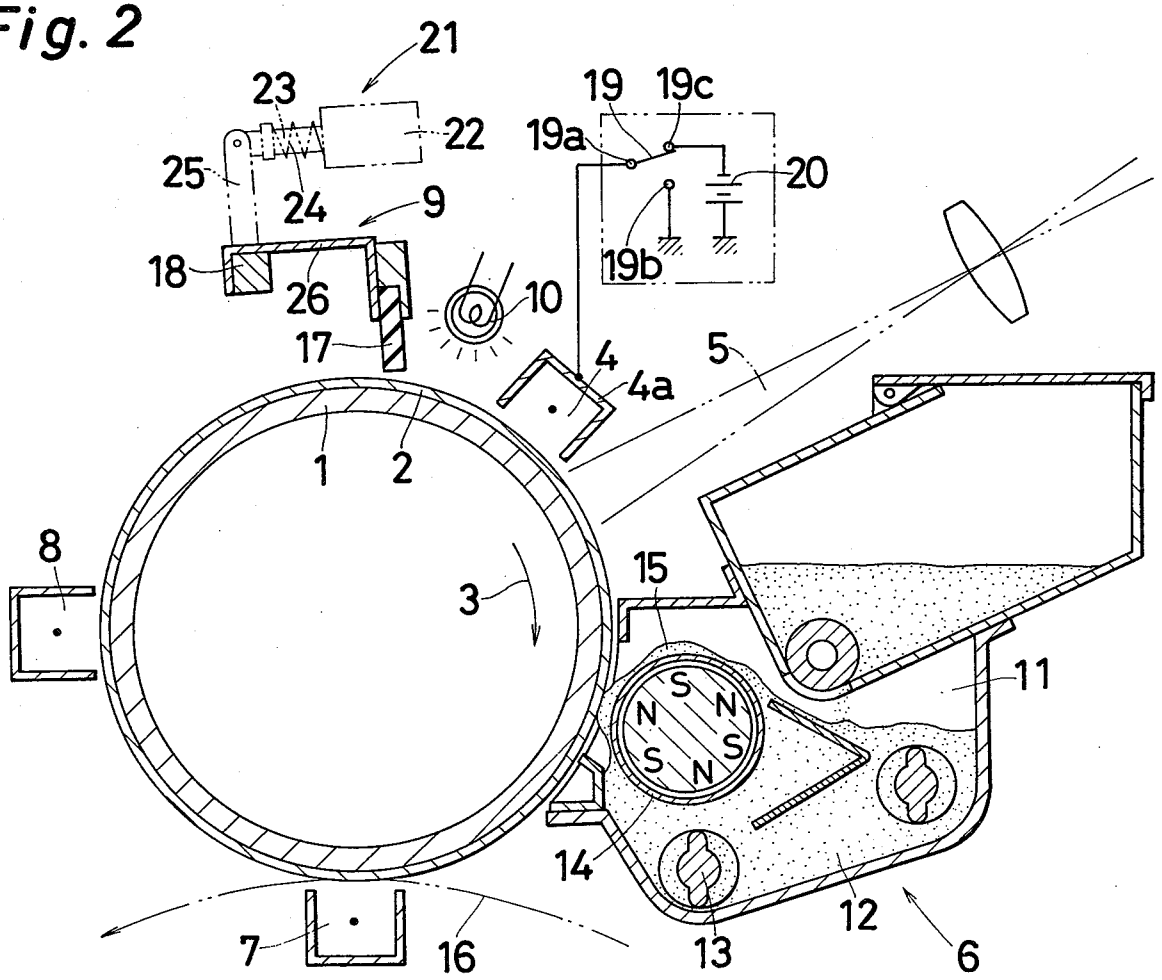
FIG. 2 is a cross-sectional view of the electrostatic copying machine shown in FIG. 1, illustrating the location of the elements thereof in a mode of operation in which no image is being formed.

During a mode of operation in which an image is formed by the exposure means 5 that irradiates the photosensitive layer 2 with a light image, the blade member 17 is kept in sliding contact with the photosensitive layer 2 to block any residual toner on the photosensitive layer 2 against movement therewith as shown in FIG. 1, thereby cleaning the photosensitive layer 2. When no image is when formed, that is, no light image is radiated by the exposure means 5 onto the photosensitive layer 2, the blade member 17 is lifted off the photosensitive layer 2 as illustrated in FIG. 2. The mass of toner which has been blocked by the blade member 17 is now fed along with the rotating drum 1 to the development unit 6 by which the toner is blended into the magnetic brush 15 and collected in the developer container 11.

The driver 21 comprises a solenoid coil 22, a plunger 23 movable in the solenoid coil 22, a spring 24 for urging the plunger 23 away from the solenoid coil 22, and an arm 25 operatively coupling the plunger 23 and the shaft 18. When the solenoid coil 22 is energized, the plunger 23 is pulled into the solenoid coil 22 to cause the blade member 17 to be moved into sliding contact with the photosensitive layer 2. When the solenoid coil 22 is de-energized, the blade member 17 is lifted off the photosensitive layer 2.

According to the present invention, the corona discharger 4 has a shield case 4*a* which is connected to ground when an image is formed on the photosensitive layer 2. When no image is formed on the photosensitive layer 2, the shield case 4*a* is kept at a potential having the same polarity as that at which the toner is charged, that is, a negative potential. To effect such selective potential application, the shield case 4*a* is connected to a common contact 19*a* of a changeover switch 19 having a contact 19*b* grounded and another contact 19*c* connected to a negative terminal of a bias power supply 20. The changeover switch 19 is controlled such that when an image is formed on the photosensitive layer 2, the contacts 19*a*, 19*b* are interconnected, and when no image is formed on the photosensitive layer 2, the contacts 19*a*, 19*c* are interconnected.

Therefore, the shield case 4*a* is kept at a potential of the same polarity as the toner, that is, a negative potential when no image is formed on the photosensitive layer 2. The toner having a negative charge, which starts moving with the photosensitive layer 2 when the blade member 17 is lifted from the photosensitive layer 2, is repelled by the shield case 4*a* of the same polarity. The amount of toner which tends to scatter off the photosensitive layer 2 and be attached to the corona discharger 4 is held to a minimum, and a substantial amount of toner is allowed to be transported from the blade member 17 to the development unit 6 while being stuck to the photosensitive layer 2 as the latter moves.

While in the illustrated embodiment the shield case 4*a* is maintained at a negative potential to repel the negatively charged toner when no image is formed on the photosensitive layer 2, the shield case 4*a* may be kept at a positive potential when the toner is positively charged. The present invention is also applicable to situations in which a developer comprising only toner (mono-component developer) is employed.

As an alternative, a casing of the charge removing lamp 10 or the development unit 6 may be biased at a potential of the same polarity as that of the charged toner when no image is formed on the photosensitive layer 2 for thereby repelling the residual toner and preventing it from scattering off the photosensitive layer 2.

With the arrangement of the invention, the charged toner on the photosensitive member is repelled by a member kept at a potential of the same polarity as that of the charged toner so that the toner will be prevented from being scattered off the photosensitive member and hence from smearing surrounding parts. The method of the invention can be carried out by a simple construction as there is no need to provide a fan for exhausting toner-laden air.

Although a certain preferred embodiment has been shown and described, it should be understood that many changes and modifications may be made thereto without departing from the scope of the appended claims.

What is claimed is:

1. A method of preventing the scattering of residual charged toner from a movable photosensitive member of an electrostatic copying of the type also including a corona discharger for charging said photosensitive member, means for forming on the thus charged photosensitive member an electrostatic latent image of an original to be copied, a development unit disposed downstream of said corona discharger with respect to the direction of movement of said photosensitive member and having a development roller for applying toner, charged at a polarity opposite to that of said photosensitive member, to said photosensitive member and thereby to develop said electrostatic latent image into a toner image, means for transferring said toner image to a recording sheet, and a blade member positioned downstream of said transferring means and upstream of said corona discharger, said method comprising:

maintaining said blade member in sliding contact with said photosensitive member during a first mode of operation of said copying machine in which an image is formed on said photosensitive member and transferred therefrom to a recording sheet, thereby blocking from movement with said photosensitive member residual charged toner not transferred to the recording sheet, and thus maintaining a mass of the thus blocked toner at a position on the upstream side of said blade member;

removing said blade member from contact with said photosensitive member during a second mode of operation of said copying machine in which no image is formed on said photosensitive member, and thereby allowing said mass of toner to move with said photosensitive member toward said development roller; and during said second mode of operation applying to a member of said copying machine, other than said photosensitive member and positioned between said blade member and said development roller, a bias potential of the same polarity as that of said toner, and thereby repelling said mass of toner toward said photosensitive member.

2. A method according to claim 1, comprising applying said bias potential to a shield case of said corona discharger during said second mode of operation in which no image is formed on said photosensitive member.

3. A method according to claim 1, wherein said bias potential is of the same polarity as said charged toner with respect to ground potential.

* * * * *